US005782282A

United States Patent [19]

Chen

[11] Patent Number: 5,782,282

[45] Date of Patent: Jul. 21, 1998

[54] FOLDABLE DOOR FOR CLOSET

[76] Inventor: Chang Than Chen, 12F., No. 426, Ming Chuan 2nd Road Chien Chen Chu, Kaohsiung, Taiwan

[21] Appl. No.: 895,944

[22] Filed: Jul. 17, 1997

[51] Int. Cl.[6] ..... E05D 15/06

[52] U.S. Cl. ..... 160/206; 160/401; 160/229.1; 49/383; 16/250

[58] Field of Search ..... 160/206, 199, 160/229.1, 135, 40; 49/383; 16/250

[56] References Cited

U.S. PATENT DOCUMENTS

| | | | |
|---|---|---|---|
| 3,092,870 | 6/1963 | Baer | 160/206 X |
| 3,405,756 | 10/1968 | Harris | 160/229.1 |
| 3,419,064 | 12/1968 | Odicini | 160/229.1 |
| 3,428,108 | 2/1969 | Singer | 160/229.1 X |
| 4,276,919 | 7/1981 | Walters | 160/206 |
| 4,284,118 | 8/1981 | Ceron | 160/229.1 |
| 4,516,619 | 5/1985 | Hasbrouck | 160/229.1 X |
| 5,060,631 | 10/1991 | Lin | 160/229.1 X |

*Primary Examiner*—David M. Purol

[57] ABSTRACT

A foldable door includes two door panels each having a rounded adjacent side. A safety member is disposed in the gap formed between the door panels and includes two curved recesses for engaging with the rounded adjacent sides of the door panels. Two couplers are secured to the safety members and each includes two shafts engaged in the door panels for pivotally coupling the door panels together and for allowing the door panels to be rotated about the shafts. The safety member may enclose the gap for preventing a user from being hurt between the door panels.

3 Claims, 3 Drawing Sheets

FOLDABLE DOOR FOR CLOSET

BACKGROUND OF THE INVENTION

1. Field of the Invention

The present invention relates to a foldable door, and more particularly to a foldable door for a closet.

2. Description of the Prior Art

Typical foldable doors, particularly the foldable doors for closets, comprise two door panels having adjacent sides pivotally coupled together at a pivot shaft for allowing the two door panels to be rotated relative to each other about the pivot shaft. However, a gap may be formed between the door panels and may hurt the user, particularly the fingers of children when the fingers are engaged into the gap formed between the door panels.

The present invention has arisen to mitigate and/or obviate the afore-described disadvantages of the conventional foldable doors.

SUMMARY OF THE INVENTION

The primary objective of the present invention is to provide a foldable door which includes a safety device for preventing the children from being hurt by the door panels.

In accordance with one aspect of the invention, there is provided a foldable door comprising two door panels each including a rounded adjacent side and each including an upper portion and a lower portion having a hole formed in the rounded adjacent side, the door panels defining a gap between the rounded adjacent sides thereof, a safety member disposed in the gap defined between the rounded adjacent sides of the door panels and including two curved recesses for engaging with the rounded adjacent sides of the door panels, two couplers each including two shafts engaged in the holes of the door panels for pivotally coupling the door panels together and for allowing the door panels to be rotated about the shafts respectively, and means for securing the safety member to the couplers for allowing the safety member to enclose the gap defined between the door panels and for allowing the safety member to prevent user from being hurt between the door panels.

Two upper bars and two lower bars are secured to the upper portions and the lower portions of the door panels, the upper and the lower bars each includes a first end having a sleeve engaged in the holes of the door panels, the upper bars each includes a second end having a roller secured thereon, the shafts of the couplers are engaged in the sleeves of the upper bars.

One of the door panels includes a second rounded side opposite to the rounded adjacent side, the foldable door further includes an end beam including a curved recess for engaging with the second rounded side of the first door panel.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
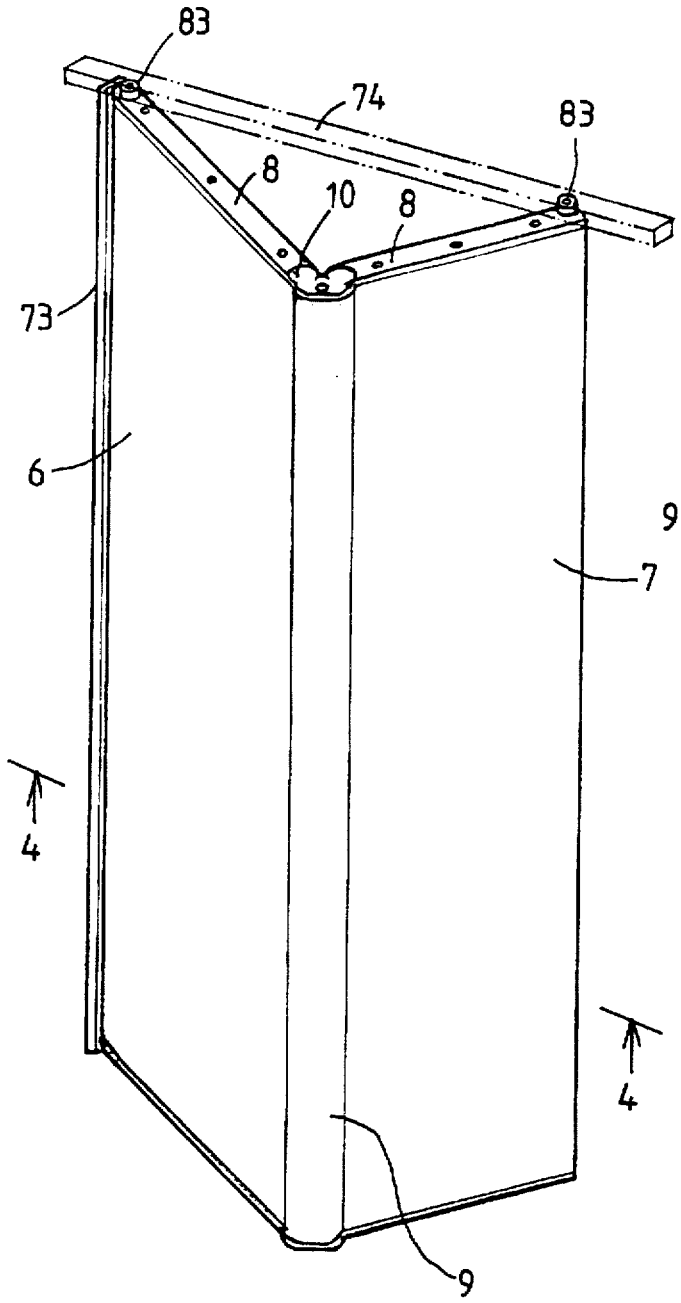
FIG. 1 is a perspective view of a foldable door in accordance with the present invention.
Figure 2:
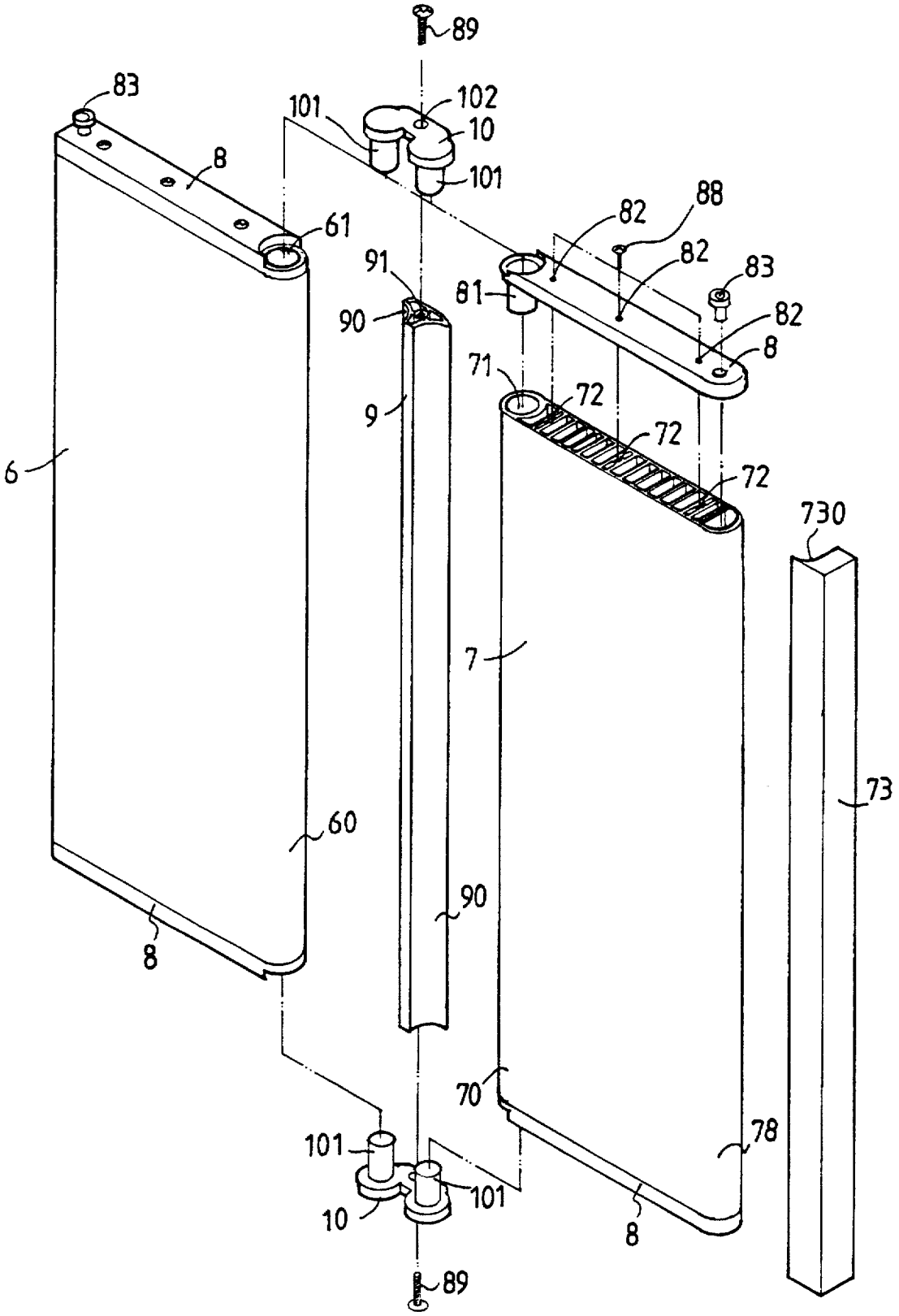
FIG. 2 is an exploded view of the foldable door.
Figure 4:
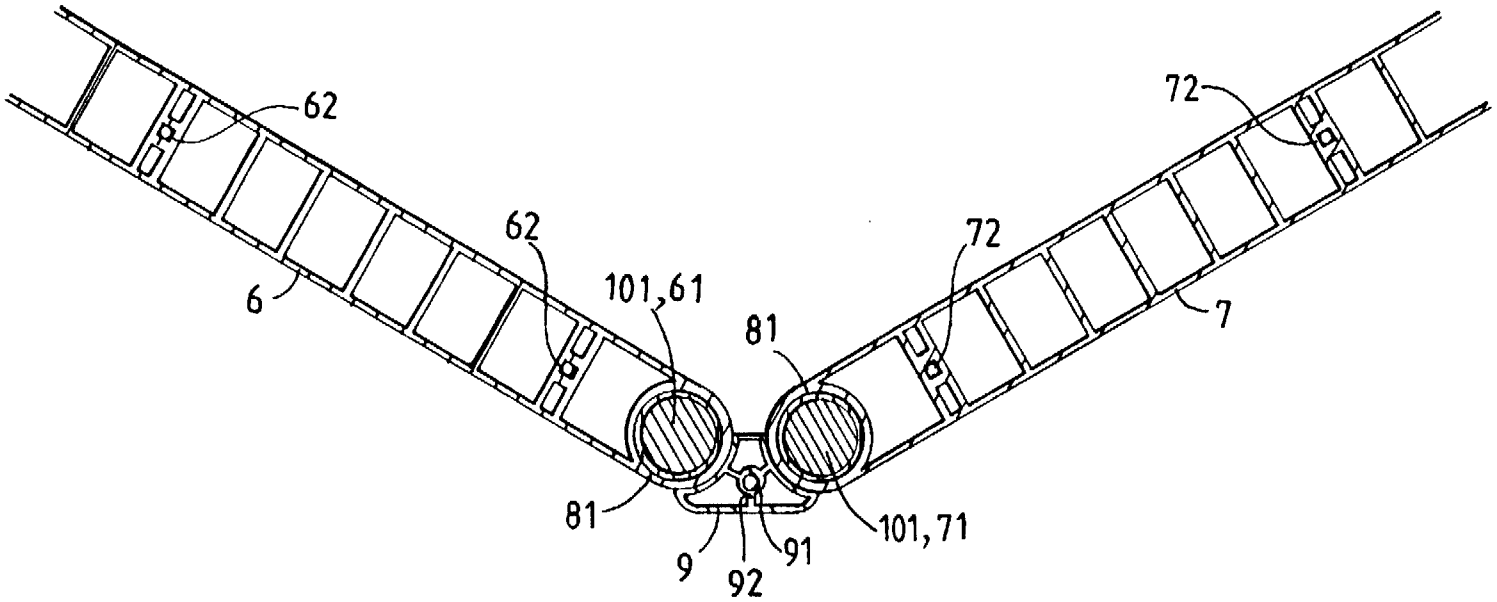
FIG. 4 is a cross sectional view taken along lines 4—4 of FIG. 1.

Referring to the drawings, and initially to FIGS. 1, 2 and 4, a foldable door in accordance with the present invention comprises two or more door panels 6, 7 including rounded adjacent sides 60, 70 to be pivotally coupled together and including a hole 61, 71 formed in the upper and the lower portion of the adjacent sides 60, 70 each. The door panels 6, 7 each includes one or more screw holes 62, 72 formed in the upper and the bottom portions for engaging with fasteners 88. The door panels 6, 7 each includes two bars 8 secured to the upper and the bottom portions by the fasteners 88. The bars 8 each includes a barrel 81 formed in one end for engaging in the holes 61, 71. The upper bars 8 each includes a roller 83 secured to the other end for slidably engaging with a track 74 (FIG. 1) of the closet.

A safety member 9 is engaged between the adjacent sides 60, 70 of the door panels 6, 7 and includes two curved recesses 90 for engaging with the rounded adjacent sides 60, 70 for allowing the door panels 6, 7 to be rotated relative to the safety member 9. The safety member 9 includes two screw holes 91 formed in the upper and the bottom portions. Two couplers 10 each includes two shafts 101 engaged in the sleeves 81 for pivotally coupling the door panels 6, 7 together and for allowing the door panels 6, 7 to be rotated about the shafts 101 respectively. Two fasteners 89 are engaged with the orifices 102 of the couplers 10 and engaged with the screw holes 91 of the safety member 9 for securing the safety member 9 between the door panels 6, 7. An end beam 73 includes a curved recess 730 for engaging with a rounded side 78 of the door panel 7 opposite to the rounded side 70. The safety member 9 may include a hollow structure having reinforcing ribs 92 for forming the screw holes 91.

Figure 3:
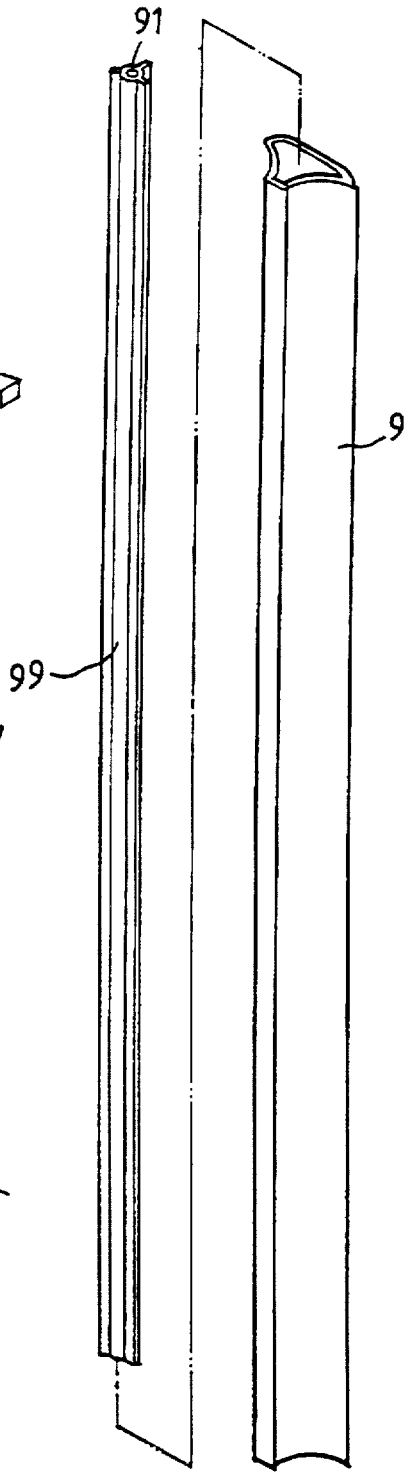
FIG. 3 is a partial exploded view showing another application of the safety device of the foldable door.

Referring next to FIG. 3, the safety member 9 may includes a post 99 formed separately and engaged in the safety member 9 after the post 99 is formed such that the post 99 and the safety member 9 may be made by different materials. The post 99 includes screw holes 91 formed in the upper and the bottom portions for engaging with the fasteners 89.

Figure 5:
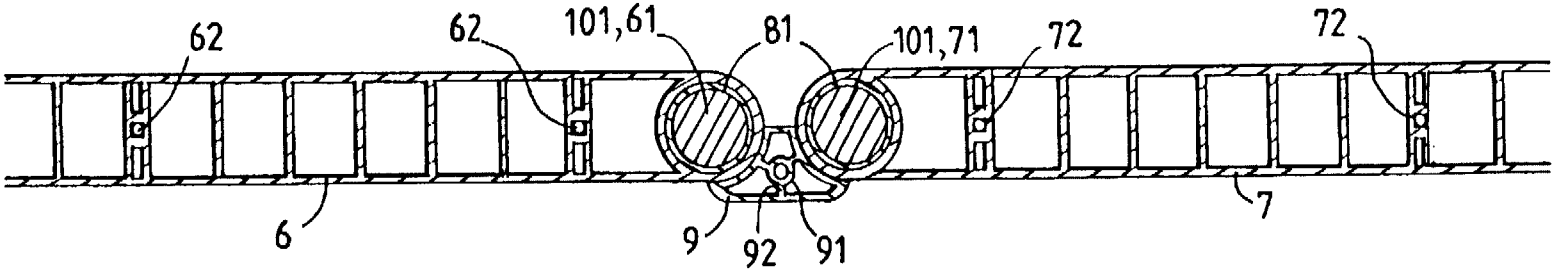
FIG. 5 is a cross sectional view similar to FIG. 4, illustrating the operation of the foldable door.

In operation, as shown in FIGS. 4 and 5, the safety member 9 may be engaged between the rounded side portions 60, 70 of the door panels 6, 7 for enclosing the gap formed between the door panels 6, 7 and for preventing any object from being jammed between the door panels 6, 7.

Accordingly, the foldable door in accordance with the present invention includes a safety member engaged between the door panels for enclosing the gap formed between the door panels and for preventing the user from being hurt by the door panels.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A foldable door comprising:

two door panels each including a rounded adjacent side and each including an upper portion and a lower portion having a hole formed in said rounded adjacent side, said door panels defining a gap between said rounded adjacent sides thereof, a safety member disposed in said gap defined between said rounded adjacent sides of said door panels and including two curved recesses for engaging with said rounded adjacent sides of said door panels, two couplers each including two shafts engaged in said holes of said door panels for pivotally coupling said door panels together and for allowing said door panels to be rotated about said shafts respectively, and means for securing said safety member to said couplers for allowing said safety member to enclose said gap defined between said door panels and for allowing said safety member to prevent user from being hurt between said door panels.

2. A foldable door according to claim 1 further comprising two upper bars and two lower bars secured to said upper portions and said lower portions of said door panels, said upper and said lower bars each including a first end having a sleeve engaged in said holes of said door panels, said upper bars each including a second end having a roller secured thereon, said shafts of said couplers being engaged in said sleeves of said upper bars.

3. A foldable door according to claim 1, wherein a first of said door panels includes a second rounded side opposite to said rounded adjacent side, said foldable door further includes an end beam including a curved recess for engaging with said second rounded side of said first door panel.

* * * * *